US011274671B2

(12) United States Patent
Bottomfield

(10) Patent No.: US 11,274,671 B2
(45) **Date of Patent: *Mar. 15, 2022**

(54) TURBINE CAP FOR TURBO-MOLECULAR PUMP

(71) Applicant: Roger L. Bottomfield, Chandler, AZ (US)

(72) Inventor: Roger L. Bottomfield, Chandler, AZ (US)

( * ) Notice: Subject to any disclaimer, the term of this patent is extended or adjusted under 35 U.S.C. 154(b) by 1154 days.

This patent is subject to a terminal disclaimer.

(21) Appl. No.: 15/340,804

(22) Filed: Nov. 1, 2016

(65) Prior Publication Data

US 2017/0058902 A1 Mar. 2, 2017

Related U.S. Application Data

(63) Continuation of application No. 14/210,168, filed on Mar. 13, 2014, now Pat. No. 9,512,853, and a continuation-in-part of application No. 13/608,933, filed on Sep. 10, 2012, now Pat. No. 9,512,848.

(60) Provisional application No. 61/783,809, filed on Mar. 14, 2013, provisional application No. 61/534,785, filed on Sep. 14, 2011.

(51) Int. Cl.

| | |
|---|---|
| ***F04D 19/04*** | (2006.01) |
| ***F04D 29/32*** | (2006.01) |
| ***F04D 29/08*** | (2006.01) |

(52) U.S. Cl.

CPC ..... *F04D 19/042* (2013.01); *F04D 29/083* (2013.01); *F04D 29/321* (2013.01); *Y10T 29/49236* (2015.01)

(58) Field of Classification Search

CPC ..... F04D 29/08; F04D 29/122; F04D 29/321; F04D 29/002; F04D 29/20; F04D 29/2216; F04D 29/2222; F04D 29/281; F04D 29/263; F04D 29/289; F04D 29/329; F04D 23/001; F04D 23/003; F04D 23/005; F04D 17/165

See application file for complete search history.

(56) References Cited

U.S. PATENT DOCUMENTS

| | | | |
|---|---|---|---|
| 303,558 | A | 8/1884 | Campbell |
| 325,221 | A | 8/1885 | Wright |
| 2,043,412 | A | 5/1936 | Klein |

(Continued)

FOREIGN PATENT DOCUMENTS

| | | |
|---|---|---|
| WO | 9407033 | 3/1994 |

*Primary Examiner* — David E Sosnowski
*Assistant Examiner* — Wayne A Lambert
(74) *Attorney, Agent, or Firm* — Brian M. Kaufman; Robert D. Atkins; Patent Law Group: Atkins and Associates, P.C.

(57) ABSTRACT

Systems here include cone shaped turbine caps mounted to a turbo molecular turbine assembly. In some embodiments, the turbo molecular turbine assembly includes a body with a top cavity, a bottom cavity and external fins, the body mounted to a pump rotor. In some embodiments, the turbo molecular turbine assembly and cone shaped turbine cap are configured to fit into a chamber and spun by the mounted pump rotor. In some embodiments, the turbine external fins are configured to pump gasses and suspended particles from the chamber when spun. And in some embodiments, the cone shaped turbine cap includes a vent channel for venting air from the top cavity.

19 Claims, 7 Drawing Sheets

(56) References Cited

U.S. PATENT DOCUMENTS 2,092,182 A 9/1937 Ray
2,434,896 A 1/1948 Ayers
2,479,862 A 8/1949 Payne
2,685,380 A 8/1954 Moeller
2,773,619 A 12/1956 Moeller
2,800,242 A 7/1957 Sauthoff
3,138,173 A 6/1964 Hartman et al.
3,163,041 A 12/1964 Karlby et al.
3,168,978 A 2/1965 Garnier et al.
3,250,221 A 5/1966 Williams
3,291,156 A 12/1966 Corsano
3,321,221 A 5/1967 Harris et al.
3,335,895 A 8/1967 Santarelli
3,387,768 A 6/1968 Zoehfeld
3,398,577 A 8/1968 Kovats et al.
3,434,656 A 3/1969 Bellmer
3,435,771 A 4/1969 Riple
3,494,504 A 2/1970 Jackson
3,508,842 A 4/1970 Lievens
3,613,936 A 10/1971 Kaiser et al.
3,618,809 A 11/1971 Matino
3,618,811 A 11/1971 Matino
3,639,074 A 2/1972 Killick
3,733,910 A 5/1973 Evans et al.
3,749,528 A 7/1973 Rousseau et al.
3,831,801 A 8/1974 Rodgers
3,877,546 A 4/1975 Shrader
3,998,245 A 12/1976 Martin
4,064,403 A * 12/1977 Miller ..... F01D 15/10 290/52
4,120,603 A 10/1978 Downing
4,203,535 A 5/1980 Burnett et al.
4,256,435 A 3/1981 Eckel
4,303,101 A 12/1981 Tholen
4,309,143 A * 1/1982 Klatt ..... F04D 19/042 29/889.23
4,312,708 A 1/1982 Leslie
4,426,190 A 1/1984 Sharpio et al.
4,493,344 A 1/1985 Mathison et al.
4,576,778 A 3/1986 Ferree et al.
4,585,033 A 4/1986 Westman
4,729,491 A 3/1988 Jensen et al.
4,753,070 A 6/1988 Werner
4,797,062 A 1/1989 Deter et al.
4,865,529 A 9/1989 Sutton et al.
5,059,092 A 10/1991 Kabelitz et al.
5,232,333 A 8/1993 Girault
5,528,618 A 6/1996 Schlie et al.
5,529,464 A 6/1996 Emerson et al.
5,553,998 A * 9/1996 Muhlhoff ..... F04D 19/046 415/143
5,577,883 A 11/1996 Schutz et al.
6,079,582 A 6/2000 Nickel et al.
6,109,887 A 8/2000 Takura et al.
6,179,573 B1 * 1/2001 Hablanian ..... F04D 19/04 415/90
6,461,123 B1 10/2002 Lotz
6,513,549 B2 2/2003 Chen
6,514,035 B2 2/2003 Iwane et al.
6,589,009 B1 * 7/2003 Shiokawa ..... F04D 19/042 415/143
6,662,490 B1 12/2003 Aesch, Jr.
6,755,611 B1 6/2004 Kabasawa et al.
7,464,727 B1 12/2008 Larson et al.
2009/0110563 A1 4/2009 Takita et al.
2010/0074751 A1 3/2010 Brown
2011/0103934 A1 * 5/2011 Ohtachi ..... F04D 19/042 415/118
2011/0189001 A1 8/2011 Zhang et al.
2012/0291451 A1 11/2012 Moehrle

* cited by examiner

TURBINE CAP FOR TURBO-MOLECULAR PUMP

CROSS REFERENCE TO RELATED APPLICATIONS

The present application is a continuation of U.S. utility patent application Ser. No. 14/210,168, now U.S. Pat. No. 9,512,853, filed on 13 Mar. 2014, which claims the benefit of U.S. provisional patent application No. 61/783,809, filed 14 Mar. 2013, all of which are incorporated herein by reference in their entirety.

The present application is further a continuation-in-part of U.S. utility patent application Ser. No. 13/608,933, now U.S. Pat. No. 9,512,848, filed 10 Sep. 2012, which claims the benefit of U.S. provisional patent application No. 61/534,785, filed 14 Sep. 2011, all of which are incorporated herein by reference in their entirety.

FIELD

The present invention relates to turbo-molecular pumps used for semiconductor manufacturing.

BACKGROUND

Turbo-molecular pumps are used to draw gasses and suspended particles from chambers that are used to process semiconductor wafers. A conventional pump is illustrated in FIG. 1, and includes a turbine 10 mounted to a pump rotor 12 via mounting bolts 14. The turbine 10 includes fins 16 used to pump the gasses and suspended particles from the chamber (not shown). The tops of the bolts 14 are recessed from the top surface of the turbine 10 in a bolt cavity 18 that has an open end. This conventional design has worked dependably in the past for many years.

Recently, however, conventional pumps having this design have been found to require increased maintenance due to excessive residual process particulate in the wafer chamber, which can result in lower yields. It was discovered that the residual process particulate originates from particles that settle into the bolt cavity 18, and after a certain amount of time and accumulation, are emitted back into the chamber where they can contaminate the wafers being processed therein. This contamination has recently become more problematic because residual process particulate from the bolt cavity 18 are no longer tolerable in many present day wafer processing applications given the reduced process geometries.

There is a need for an improved turbine that prevents excessive residual process particulate.

SUMMARY OF THE INVENTION

Systems and methods here include example embodiments with a turbine cap assembly comprising a cap member having a first hole and a first portion with a first circumference, a plate member having a second circumference and a second hole, an o-ring disposed between the cap member and plate member, and having a third circumference, and a threaded bolt extending through the first hole and second hole, wherein a distance between the cap member and the plate member is adjustable by rotation of the threaded bolt between a first position in which the o-ring is compressed by the cap member and the plate member and a second position in which the o-ring is not compressed by the cap member and the plate member. Certain embodiments include where in the first position, the third circumference is greater than the first and second circumferences, and in the second position, at least one of the first and second circumferences is greater than the third circumference.

Some embodiments include where the cap member includes a first chamfered outer edge, the plate member includes a second chamfered outer edge, and in the first position, the o-ring is compressed by and between the first and second chamfered outer edges. Certain embodiments include where the o-ring is comprised of rubber. Some embodiments include the assembly with the cap member includes a second portion with a larger circumference than the first circumference, and wherein the second portion has an upper surface in a shape of at least one of parabolic, square, rounded, conical and asymmetrical. Certain embodiments have the cap member including at least one vent. Some example embodiments have where the cap member includes one or more fins extending from an upper surface thereof. Certain embodiments include wherein the cap member includes a channel formed into an upper surface thereof.

Certain example embodiments here include where the turbine cap assembly includes cutouts in at least one of the cap and plate. Some embodiments include wherein the first hole extends completely through the cap member. Certain embodiments have wherein the first hole in the cap member is threaded and some include wherein the second hole in the plate member is threaded.

Some embodiments include systems and methods with a capped turbine assembly comprising a turbine that includes a bolt cavity formed into a top surface of the turbine and having inside walls and an open end, a plurality of fins extending from the turbine, and a plurality of bolts extending through the turbine for mounting the turbine to a pump rotor, wherein tops of the plurality of bolts are recessed from the top surface in the bolt cavity, and a cap assembly that includes, a cap member having a first hole and a first portion with a first circumference, a plate member having a second circumference and a second hole, an o-ring disposed between the cap member and plate member, and having a third circumference, and a threaded bolt extending through the first hole and the second hole, wherein a distance between the cap member and the plate member is adjustable by rotation of the threaded bolt between a first position in which the o-ring is compressed by the cap member and the plate member to engage with the inside walls to secure the cap assembly to the turbine, and a second position in which the o-ring is not compressed by the cap member and the plate member to release the cap assembly from the turbine.

Certain embodiments include wherein in the first position, the third circumference is greater than the first and second circumferences, and in the second position, at least one of the first and second circumferences is greater than the third circumference. Some embodiments include the assembly with the cap member includes a first chamfered outer edge, the plate member includes a second chamfered outer edge, and in the first position, the o-ring is compressed by and between the first and second chamfered outer edges. Some example embodiments have the o-ring comprised of rubber. In some embodiments here the cap member includes a second portion with a larger circumference than the first circumference, and wherein the second portion has an upper surface in a shape of at least one of parabolic, square, rounded, conical and asymmetrical. In certain embodiments, the cap member includes at least one vent.

Certain embodiments have the cap member include one or more fins extending from an upper surface thereof. Some example embodiments have the cap member include a channel formed into an upper surface thereof. Some embodiments have cutouts included in at least one of the cap member and plate member. Some have the first hole extend completely through the cap member. Some embodiments have the first hole in the cap member threaded. Some example embodiments have the second hole in the plate member threaded.

Some example embodiments include systems and methods of capping a turbine assembly with a cap assembly, wherein the turbine assembly includes, a bolt cavity formed into a top surface of the turbine and having inside walls and an open end, a plurality of fins extending from the turbine, and a plurality of bolts extending through the turbine for mounting the turbine to a pump rotor, wherein tops of the plurality of bolts are recessed from the top surface in the bolt cavity, wherein the cap assembly includes, a cap member having a first hole and a first portion with a first circumference, a plate member having a second circumference and a second hole, an o-ring disposed between the cap member and plate member, and having a third circumference, and a threaded bolt extending through the first hole and engaged with the second hole, wherein a distance between the cap member and the plate member is adjustable by rotation of the threaded bolt between a first position in which the o-ring is compressed by the cap member and a second position in which the o-ring is not compressed by the cap member and the plate member, the method comprising, inserting the cap member and plate member of the cap assembly into the bolt cavity with the cap assembly in the second position, rotating the threaded bolt to move the cap assembly into the first position such that the o-ring engages with the inside walls of the bolt cavity to secure the cap assembly to the turbine assembly.

Some example embodiments have cutouts included in at least one of the cap member and plate member. Some embodiments have the first hole extend completely through the cap member. Certain embodiments have the first hole in the cap member threaded. Certain example embodiments have the second hole in the plate member threaded.

DETAILED DESCRIPTION

Figure 1:
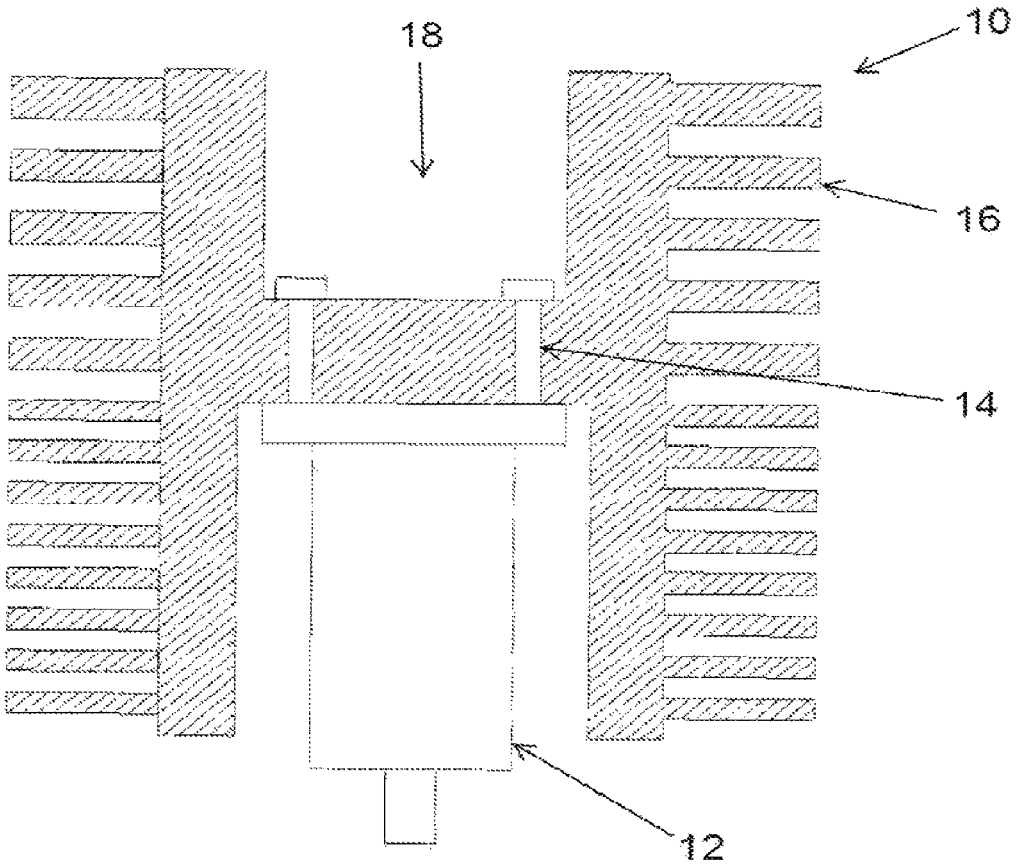
FIG. 1 (Prior Art)
FIG. 1 is a cross sectional side view of a conventional turbo-molecular pump according to some embodiments herein.
Figure 2:
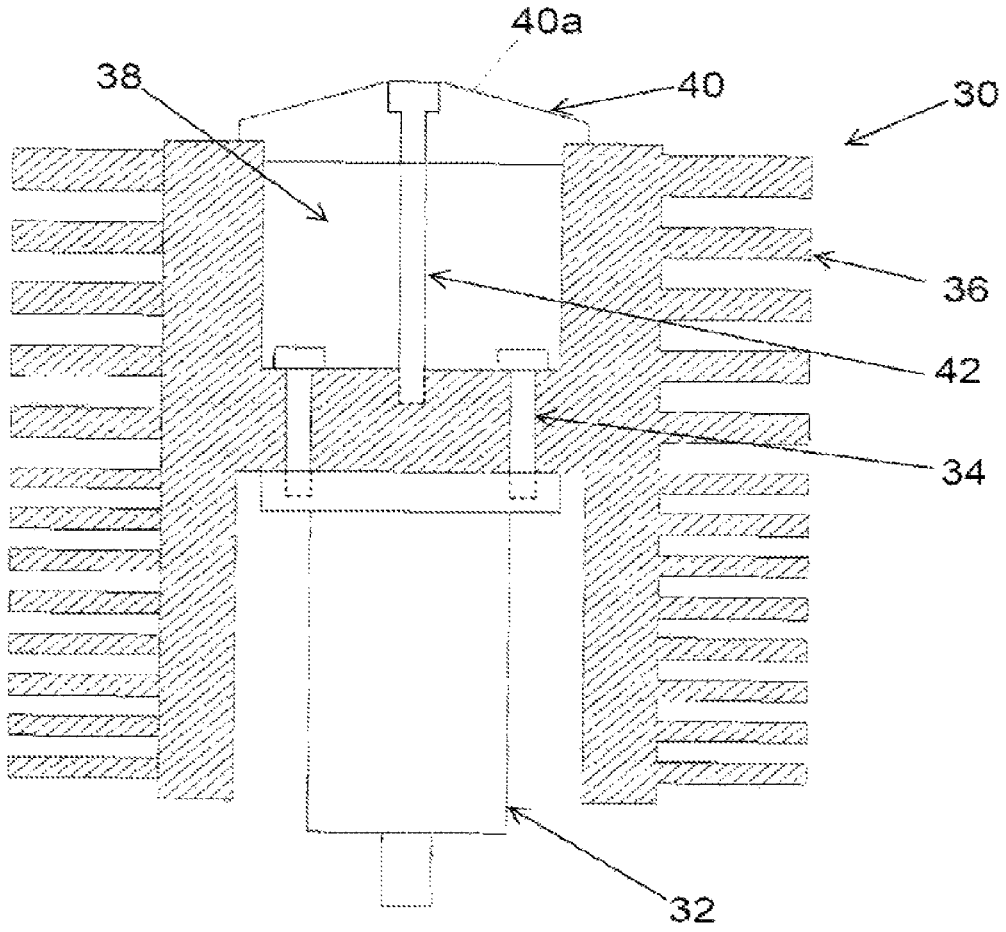
FIG. 2 is a cross sectional side view of the turbo-molecular pump of the present invention according to some embodiments herein.

The present invention is an improved turbine 30 as illustrated in FIG. 2. Turbine 30 is mounted to a pump rotor 32 via mounting bolts 34. The turbine 30 includes fins 36 used to pump the gasses and suspended particles from the chamber (not shown). The tops of the bolts 34 are recessed from the top surface of the turbine 30 in a bolt cavity 38 that has an open end. A cap member 40 is mounted over and seals the open end of the bolt cavity 38. The cap member 40 is mounted to the turbine via a center bolt 42 with sufficient force to form a seal between cap member 40 and turbine 30. The cap member 40 serves two important functions. First, it prevents particles from settling into the bolt cavity 38, where they could later be expelled back into the chamber, and/or preventing any particles in bolt cavity 38 from being expelled out into the chamber. Second, cap 40 has a shaped upper surface 40*a* which deflects particles away from the center of the turbine and toward the turbine's fins, so that they can be more effectively evacuated from the chamber. Surface 40*a* is preferably cone-shaped (conically shaped), which deflects downwardly moving particles outwardly toward the turbine fins.

The inventive solution can be implemented on existing pumps without having to reconfigure the turbines therein. With the present invention, maintenance intervals can be lengthened due to reduced contamination from the bolt cavity.

Figure 3A:
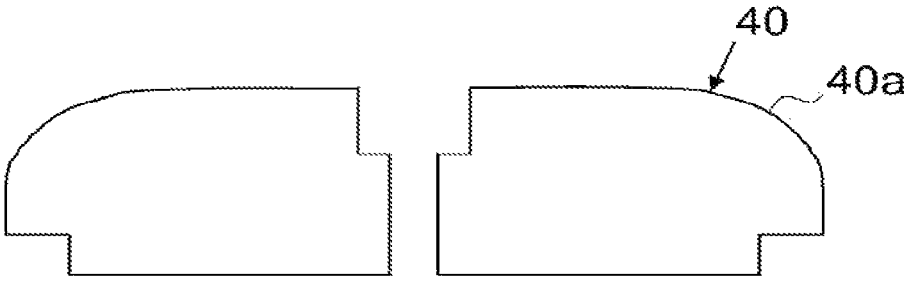
FIG. 3A is a cross sectional side view of the cap member with a parabolic shaped upper surface according to some embodiments herein.
Figure 3B:
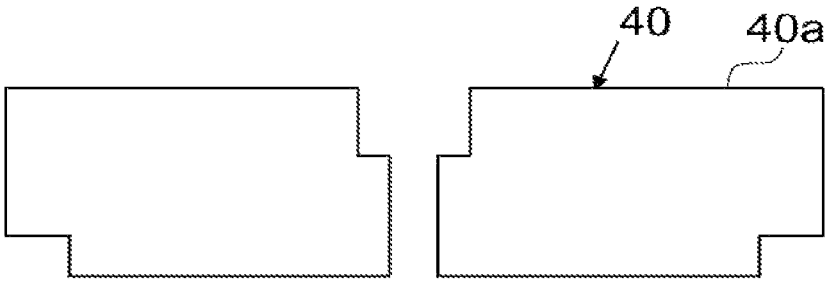
FIG. 3B is a cross sectional side view of the cap member with a squared shaped upper surface according to some embodiments herein.
Figure 3C:
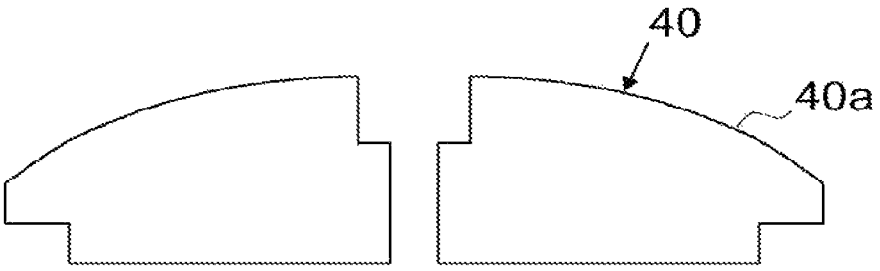
FIG. 3C is a cross sectional side view of the cap member with a rounded shaped upper surface according to some embodiments herein.
Figure 4A:
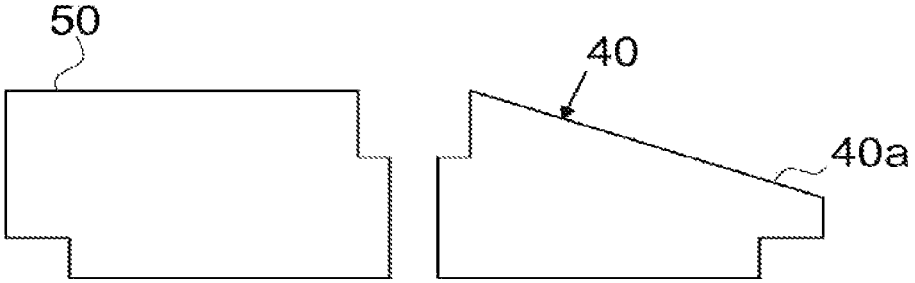
FIG. 4A is a cross sectional side view of the cap member with a fin on its upper surface according to some embodiments herein.
Figure 4B:
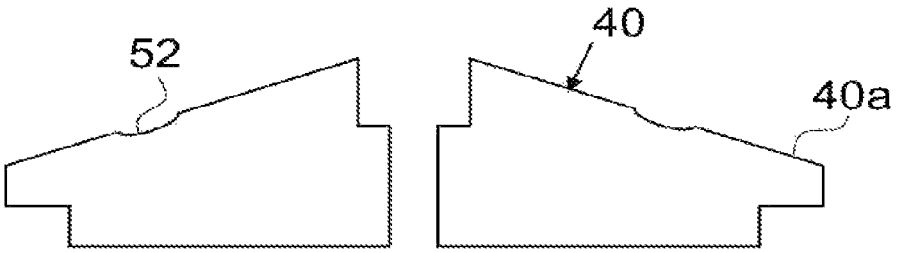
FIG. 4B is a cross sectional side view of the cap member with a channel on its upper surface according to some embodiments herein.
Figure 4C:
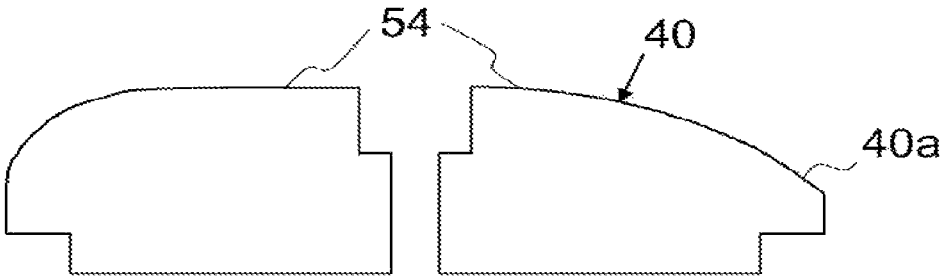
FIG. 4C is a cross sectional side view of the cap member with an asymmetric shaped upper surface according to some embodiments herein.

Surface 40*a* could alternately have a shape other than conical to assist in deflecting particles and/or gasses outwardly, such as a parabolic, squared, or rounded, as illustrated in FIGS. 3A-3C, respectively, or any other appropriate convex shape. Additionally, since the cap member 40 is spinning with the turbine 30, particle deflecting features can be formed on the cap's upper surface, such as fins 50, channels 52, or asymmetric convex shapes 54, as illustrated in FIGS. 4*a*-4C, respectively, to enhance particle deflection as the cap member 40 rotates.

Figure 5A:
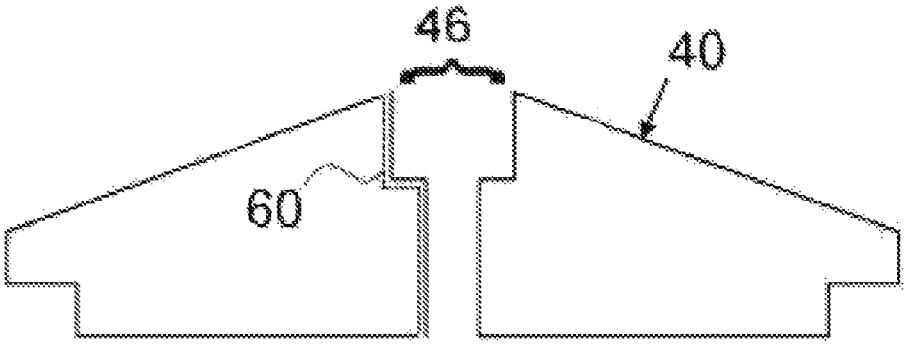
FIG. 5A is a cross sectional side view of the cap member with a vent channel along the center bolt aperture according to some embodiments herein.
Figure 5B:
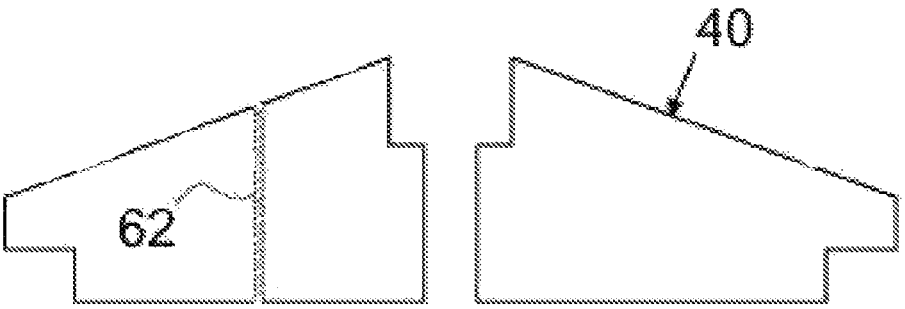
FIG. 5B is a cross sectional side view of the cap member with a vent channel extending therethrough according to some embodiments herein.
Figure 6:
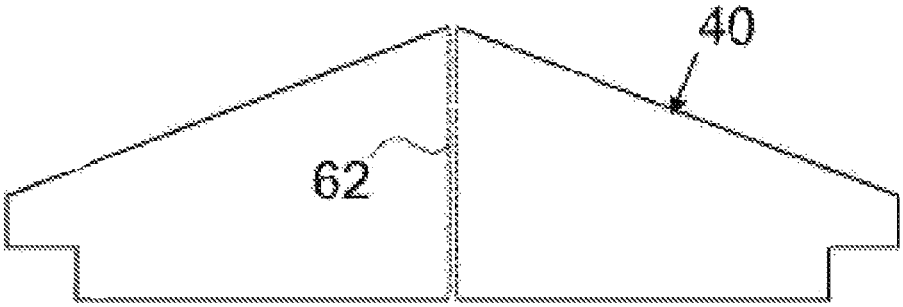
FIG. 6 is a cross sectional side view of the cap member with a vent channel extending therethrough without a center bold aperture (i.e. for friction fit) according to some embodiments herein.

Optionally, the bolt cavity 38 can be vented, to allow the cavity 38 to evacuate to high vacuum during operation in certain applications. The venting can be achieved by an open or closed channel formed in the cap. FIG. 5A illustrates a vent channel 60 as part of the center bolt aperture 46 through the cap member 40. FIG. 5B illustrates a vent channel 62 formed through the cap member 40. FIG. 6 illustrates a vent channel 62, without a center bolt aperture (i.e. secured using a friction fit). With this configuration, cap member 40 can be mounted to turbine 30 via a friction fit instead of by center bolt 42.

Figure 7:
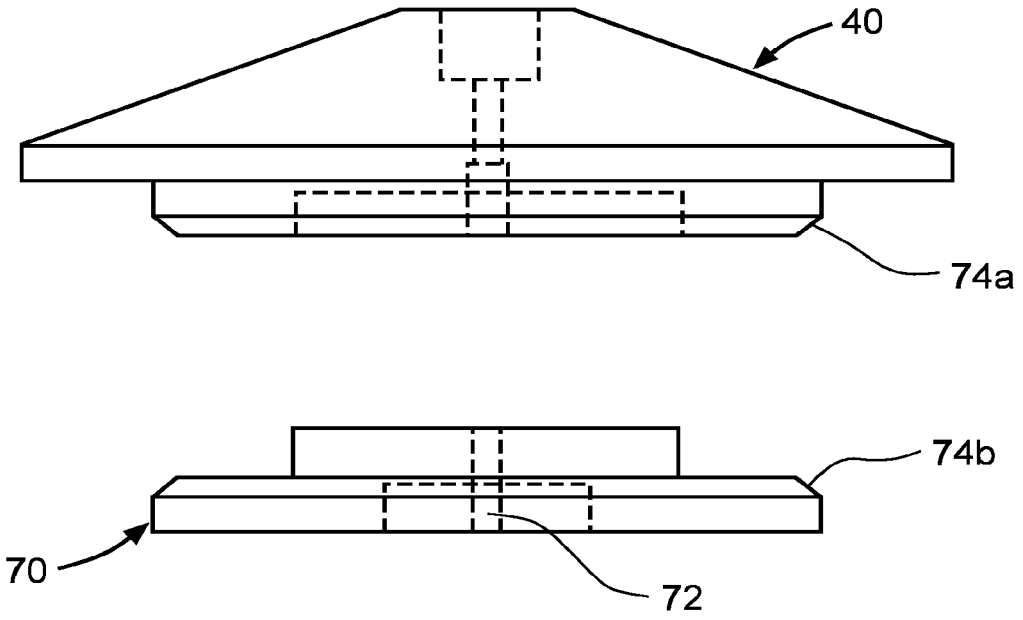
FIGS. 7-8 are cross sectional side views of a cap member assembly with a compressible o-ring for a sealing friction fit according to some embodiments herein.
Figure 8:
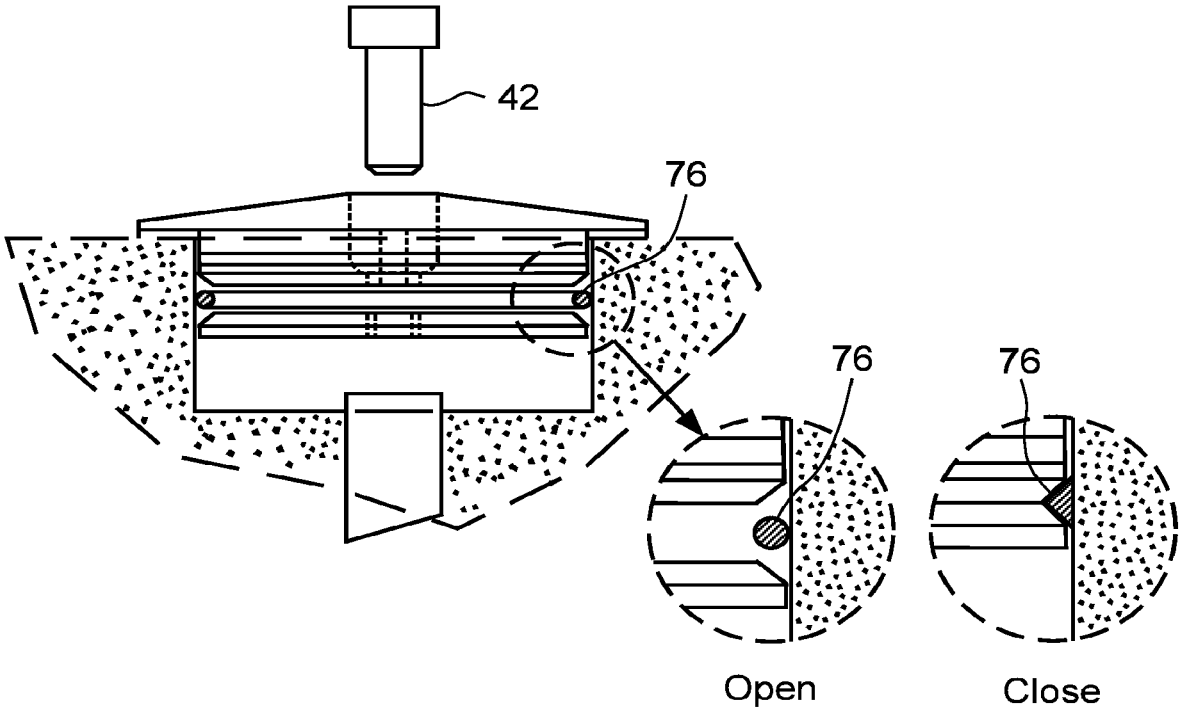

FIGS. 7-8 illustrate an example embodiments of cap member 40 with an adjustable friction fit. The cap member 40 includes a plate member 70 (together forming a cap member assembly), where the plate member 70 is dimensioned to fit inside bolt cavity 38. Plate member 70 includes a threaded hole 72 for receiving the center bolt 42. The cap member 40 and plate member 70 have opposing chamfered outer edges 74*a* and 74*b*. An o-ring 76 (e.g. made of rubber or other compressible material) is positioned between the cap member 40 and plate member 70. With the bolt 42 loosely engaged between cap member 40 and plate member 70 (e.g. an open position), the plate member 70 is inserted inside bolt cavity 38 until cap member 40 seats on the top surface of turbine 30 (as illustrated in FIG. 8). As the bolt 42 is tightened, the plate 70 is drawn toward cap member 40 to a closed position wherein the chamfered surfaces 74*a*/74*b* compress the o-ring 76 against the side surface of the cavity 38. The compressed o-ring 76 forms a seal between cap member 40 and the side surface of the cavity 38, as well as provides a friction fit therebetween to removably secure the cap member 40 to the turbine 30. This design facilities a convenient and reliable way to secure and remove the cap member 40 from turbine 30. This design also avoids the need to use a bolt connection with the turbine 30 (i.e. is compatible with turbines which do not have a threaded hole for engaging with bolt 42).

Figure 9:
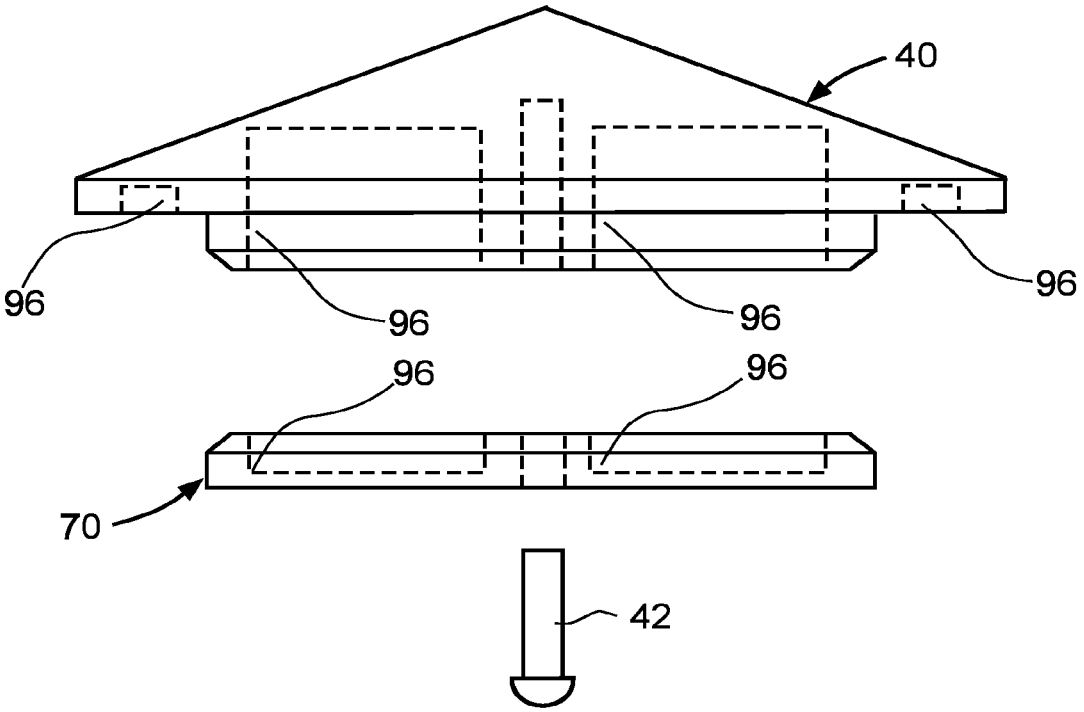
FIG. 9 is a cross sectional side view of the cap member with cutouts according to some embodiments herein.

FIG. 9 illustrates an example embodiment wherein the cap member 40 and plate member 70 include cutouts 96 in various places. These cutouts are shown in exemplary places and depths on both the cap 40 and plate 70 but could be put in at varying depths and angles and places. The example cutouts in FIG. 9 are shown as channels in the cap and plate members, but could be any variation of cutout besides a channel. Such example cutouts may save weight on the cap and plate and make them lighter. Such example cutouts could also be used for balancing the cap member assembly. It is to be understood that such cutouts could be used in any embodiment for weight savings and/or balancing purposes.

In the example embodiment of FIG. 9, the bolt 42 is shown inserted from the bottom of the plate 70 and up into the cap member 40 as an example only. In this example, the hole in the cap 40 is threaded and not the hole in the plate. The plate 70 could include the bolt 42 affixed to it, or as a separate part, as shown in FIG. 9. In either case, the bolt 42 in this example extends up into the cap member's hole, and not down through the cap and also through into the plate.

Thus, in the example embodiment of FIG. 9, there is no bolt hole or recess in the top of the cap member 40. Such an arrangement may provide fewer places for particulates to accumulate when in use. Thus, the cap top in this embodiment is shown with a peak, but could be rounded or squared off, or any kind of shape that would prevent accumulation of particles.

It is to be understood that the present invention is not limited to the embodiment(s) described above and illustrated herein. For example, references to the present invention herein are not intended to limit the scope of any claim or claim term, but instead merely make reference to one or more features that may be covered by one or more claims. Materials, processes and numerical examples described above are exemplary only, and should not be deemed to limit the claims.

What is claimed is:

1. A turbo-molecular pump, comprising:
a rotor;
a turbine mounted to the rotor and including a recess opposite the rotor;
a bolt attached to the rotor through an opening of the turbine and including a portion of the bolt disposed in the recess; and
a cap disposed over the recess, wherein the cap includes a vent channel formed through the cap.

2. The turbo-molecular pump of claim 1, wherein the cap includes a convex upper surface.

3. The turbo-molecular pump of claim 1, wherein the cap includes a conically shaped surface oriented away from the recess.

4. The turbo-molecular pump of claim 3, wherein the conically shaped surface includes a central point.

5. The turbo-molecular pump of claim 1, further including a cutout formed in the cap.

6. The turbo-molecular pump of claim 1, wherein the cap is mounted to the turbine by a friction fit O-ring.

7. A turbo-molecular pump, comprising:
a rotor;
a turbine mounted to the rotor and including a recess oriented away from the rotor, wherein the recess comprises a bottom surface and a side surface within the recess;
a cap disposed over the recess, wherein the cap includes a plate member comprising a cutout formed in the plate member; and
an o-ring compressed between the cap and the side surface of the recess.

8. The turbo-molecular pump of claim 7, further including a vent channel formed through the cap.

9. The turbo-molecular pump of claim 7, further including a chamber disposed over the cap, wherein the turbo-molecular pump is configured to evacuate molecules from the chamber.

10. The turbo-molecular pump of claim 7, further including a bolt extending through the bottom surface of the recess to attach the turbine to the rotor.

11. The turbo-molecular pump of claim 10, wherein the side surface of the recess is perpendicular to the bottom surface.

12. The turbo-molecular pump of claim 10, wherein friction between the o-ring and the side surface of the recess holds the cap in place on the turbine.

13. A method of making a turbo-molecular pump, comprising:
providing a turbine including a recess;
mounting the turbine to a rotor with the recess oriented away from the rotor; and
disposing a cap over the recess, wherein the cap includes a vent channel.

14. The method of claim 13, wherein the cap includes a convex upper surface.

15. The method of claim 13, wherein the cap includes a conically shaped upper surface.

16. The method of claim 15, wherein the conically shaped upper surface includes a central point.

17. The method of claim 13, wherein the vent extends from the recess to allow evacuation of molecules from the recess.

18. The method of claim 13, further including mounting the cap in the recess using a friction fit O-ring.

19. The method of claim 13, wherein the cap includes a plate member comprising a cutout formed in the plate member.

* * * * *